US009260988B2

(12) United States Patent
Lin

(10) Patent No.: US 9,260,988 B2
(45) Date of Patent: Feb. 16, 2016

(54) SELF-HELP OIL CHANGING APPARATUS

(71) Applicant: EUROILTEC INDUSTRY CO., LTD., Kaohsiung (TW)

(72) Inventor: Hsin-Hsiang Lin, Kaohsiung (TW)

(73) Assignee: Euroiltec Industry Co., Ltd., Kaohsiung (TW)

( * ) Notice: Subject to any disclaimer, the term of this patent is extended or adjusted under 35 U.S.C. 154(b) by 335 days.

(21) Appl. No.: 14/024,714

(22) Filed: Sep. 12, 2013

(65) Prior Publication Data

US 2015/0068843 A1 Mar. 12, 2015

(51) Int. Cl.
*F01M 11/04* (2006.01)

(52) U.S. Cl.
CPC ..... *F01M 11/045* (2013.01); *F01M 11/0458* (2013.01)

(58) Field of Classification Search
CPC ..... F01M 11/045; F01M 11/0458
USPC ..... 184/1.5; 141/214, 215, 225, 59, 65, 141/198, 285
See application file for complete search history.

(56) References Cited

U.S. PATENT DOCUMENTS 1,702,703 A * 2/1929 Osborne ..... F01M 11/0458 134/111
2,300,450 A * 11/1942 Saussure ..... F01M 11/0458 134/107
2,552,749 A * 5/1951 Tabet ..... F01M 11/045 134/113
3,095,062 A * 6/1963 Neely ..... B67D 7/845 138/109
3,430,730 A * 3/1969 Kitajima ..... F01M 11/045 184/1.5
4,090,539 A * 5/1978 Krupp ..... B67D 7/54 141/198
4,095,673 A * 6/1978 Takeuchi ..... B67D 7/845 184/1.5
5,415,247 A * 5/1995 Knorr ..... F01M 11/0458 141/65
5,746,259 A * 5/1998 Noble, III ..... B60H 1/00585 134/169 A
6,302,167 B1 * 10/2001 Hollub ..... B60T 17/221 141/65
6,595,228 B1 * 7/2003 Rome ..... F01M 11/0458 137/1
7,111,650 B2 * 9/2006 Few ..... F01P 11/06 141/59
8,104,522 B2 * 1/2012 Flournoy ..... F16H 57/0408 141/65
2001/0022203 A1 * 9/2001 Rome ..... F01M 11/0458 141/98
2004/0084105 A1 * 5/2004 Awad ..... F04F 1/02 141/65
2004/0159495 A1 * 8/2004 Erwin ..... B62D 5/062 184/1.5
2005/0115631 A1 * 6/2005 Davis ..... B67D 7/42 141/31
2010/0224280 A1 * 9/2010 Burris ..... B67D 7/52 141/1

(Continued)

FOREIGN PATENT DOCUMENTS

JP H0648494 A 2/1994
JP H06122500 A 5/1994
JP H11227893 A 8/1999

(Continued)

*Primary Examiner* — William A Rivera
*Assistant Examiner* — Michael Riegelman
(74) *Attorney, Agent, or Firm* — Alan D Kamrath; Kamrath IP Lawfirm, P.A.

(57) ABSTRACT

A self-help oil changing apparatus includes a nozzle having an outer tube in which an oil suction tube and an oil filling tube are received. Each of the oil suction tube and the oil filling tube has an end extending out of an insertion end of the outer tube. A clean oil tank and a dirty oil tank are respectively in communication with the other ends of the oil filling tube and the oil suction tube. An oil pressure control module includes a dirty oil pump and a clean oil pump. The dirty oil pump is connected to the oil suction tube and is in communication with the dirty oil tank. The clean oil pump is in communication with the oil filling tube and the clean oil tank. A control unit is electrically connected to and controls operations of the dirty oil pump and the clean oil pump.

16 Claims, 8 Drawing Sheets

(56) References Cited

U.S. PATENT DOCUMENTS

| | | | | |
|---|---|---|---|---|
| 2011/0194953 | A1* | 8/2011 | Schalk | F16H 57/0408 417/313 |
| 2014/0048173 | A1* | 2/2014 | Fedde | B67D 7/02 141/311 A |

FOREIGN PATENT DOCUMENTS

| | | | |
|---|---|---|---|
| JP | 2001072199 | A | 3/2001 |
| TW | M417947 | U | 12/2011 |
| TW | M426705 | U | 4/2012 |

* cited by examiner

SELF-HELP OIL CHANGING APPARATUS

BACKGROUND OF THE INVENTION

1. Field of the Invention

The present invention relates to a self-help oil changing apparatus and, more particularly, to a self-help oil changing apparatus operable by a user to change oil for vehicle.

2. Description of the Related Art

Engine oil change per 1000 km is the basic and most common maintenance of motorcycles. Most consumers send their motorcycles to maintenance works and ask a worker to help them change the engine oil. An engine oil change process generally includes: (1) removing a bolt from an oil drain hole to drain the dirty engine oil; (2) leaning the motorcycle leftward to drain the remaining dirty engine oil when the flow of the dirty engine oil becomes smaller; (3) putting the bolt back into the oil drain hole and tightening the bolt; (4) removing a plug from an oil filling port by pliers, and inserting a funnel into the oil filling port; (5) slowing pouring clean engine oil into the funnel; and (6) after filling of the clean engine oil is finished, remove the funnel and put the plug back into the oil filling port, accomplishing the engine oil change.

However, the troublesome engine oil change process takes about 10-20 minutes, which is inefficient. Furthermore, the skin of the hand of the worker is often stained with the engine oil, which is detrimental to the health after years of working. Further, the engine oil process is generally conducted in and, thus, restricted by the working hours of the maintenance works, which is not always convenient to the consumers. Further, each engine oil bottle includes a bottle body, a sealing film and at least one label. These packaging materials also incur costs to the consumers in addition to the engine oil and the labor cost of the worker. The total costs per engine oil change are about NT$150-250 in Taiwan. Although the expense may not be a burden to the consumers, the consumers often ignores the importance of regular maintenance of the vehicles and are unwilling to regularly change the engine oil under the pressure of increasing expenses of consumable energy including gasoline. Namely, the consumers would rather drive extra hundreds of kilometers to reduce the average maintenance costs. As a result, the vehicle engines are liable to damage and, thus, have a shortened service life. Further, 15 million motorcycles consume about 200 million bottles of engine oil. The packaging materials of these engine oil bottles result in a huge amount of garbage and cause a big problem to environmental protection.

SUMMARY OF THE INVENTION

An objective of the present invention is to provide a self-help oil changing apparatus that can be operated through simple operational steps to increase the oil changing efficiency.

Another objective of the present invention is to provide a self-help oil changing apparatus preventing the user from contacting with the oil, avoiding adverse affect to the health.

A further objective of the present invention is to provide a self-help oil changing apparatus allowing use by the user at any time without restriction by the working hours of maintenance works, increasing the use convenience.

Still another objective of the present invention is to provide a self-help oil changing apparatus to reduce the costs for changing the oil to encourage the user to change the oil regularly.

Yet another objective of the present invention is to provide a self-help oil changing apparatus to effectively reduce the garbage by significantly saving the packaging materials.

The present invention fulfills the above objectives by providing a self-help oil changing apparatus including a nozzle having an outer tube, an oil suction tube, and an oil filling tube. The outer tube has an insertion end. The oil suction tube and the oil filling tube are received in the outer tube. Each of the oil suction tube and the oil filling tube has an end extending out of the insertion end of the outer tube. A clean oil tank is in communication with the other end of the oil filling tube. A dirty oil tank is in communication with the other end of the oil suction tube. An oil pressure control module includes a dirty oil pump and a clean oil pump. The dirty oil pump is connected to the oil suction tube and is in communication with the dirty oil tank. The clean oil pump is in communication with the oil filling tube and the clean oil tank. A control unit is electrically connected to the dirty oil pump and the clean oil pump to control operations of the dirty oil pump and the clean oil pump.

Preferably, the oil suction tube further includes a pressure sensor electrically connected to the control unit.

Preferably, the nozzle further includes an overflow tube extending through the outer tube. The overflow tube extends out of the insertion end of the outer tube together with the ends of the oil suction tube and the oil filling tube. The oil pressure control module further includes an overflow pump connected to the overflow tube and in communication with the dirty oil tank. The overflow pump is electrically connected to the control unit.

Preferably, a length of the overflow tube extending out of the insertion end of the outer tube is smaller than a length of the oil filling tube extending out of the insertion end of the outer tube.

Preferably, the self-help oil changing apparatus further includes a housing receiving the clean oil tank, the dirty oil tank, and the oil pressure control module. The outer tube of the nozzle is exposed outside of the housing. Each of the oil suction tube and the oil filling tube has an exposed portion exposed outside of the housing.

Preferably, the nozzle further includes a grip connected to the other end of the outer tube. The oil suction tube and the oil filling tube extend through an interior of the grip. The grip includes an actuation switch electrically connected to the control unit.

Preferably, the nozzle further includes a receiving tube. Each of the receiving tube, the oil suction tube, and the oil filling tube is a flexible hose. The receiving tube includes an end connected to the grip. The exposed portion of each of the oil suction tube and the oil filling tube is enveloped by the receiving tube.

Preferably, the self-help oil changing apparatus further includes a clean oil temporary storage assembly and a dirty oil temporary storage assembly. Each of the clean oil temporary storage assembly and the dirty oil temporary storage assembly has a temporary storage tank received in the housing. The housing includes a window aligned with the temporary storage tanks of the clean oil temporary storage assembly and the dirty oil temporary storage assembly.

Preferably, the dirty oil temporary storage assembly further includes a first oil tube, a second oil tube, and a first valve. The first oil tube has two ends respectively connected to the temporary storage tank of the dirty oil temporary storage assembly and an end of the dirty oil pump. The second oil tube has two ends respectively connected to the temporary storage tank of the dirty oil temporary storage assembly and the dirty oil tank. The first valve is mounted on the second oil tube and electrically connected to the control unit. The clean oil temporary storage assembly further includes a third oil tube and a second valve. The third oil tube has two ends respectively connected to the temporary storage tank of the clean oil temporary storage assembly and an end of the clean oil pump. The other end of the oil filling tube is in communication with the temporary storage tank of the clean oil temporary storage assembly. The second valve is mounted on the oil filling tube and electrically connected to the control unit.

Preferably, the third oil tube includes a flow meter electrically connected to the control unit.

Preferably, the outer tube is a rigid tube and has a label portion. The label portion is a mark on an outer periphery of the outer tube, or a protrusion formed on the outer periphery of the outer tube, or a bend of the outer tube.

Preferably, a length of the oil suction tube extending out of the insertion end of the outer tube is larger than the length of the oil filling tube extending out of the insertion end of the outer tube.

Preferably, each of the clean oil tank and the dirty oil tank includes an oil level sensor electrically connected to the control unit.

Preferably, the housing further includes a payment device electrically connected to the control unit.

Preferably, the housing further includes a touch control screen electrically connected to the control unit, with the touch control screen adapted to be operated by a user to control an amount of clean oil to be changed, to display operation statuses, or to display operational instructions.

Preferably, the housing further includes an alarm device electrically connected to the control unit. In an example, the alarm device is an alarm light adapted to flash if problems occur, and the touch control screen is adapted to display instructions for fixing the problems. In another example, the alarm device is a microcomputer having a loud speaker, the loud speaker is adapted to generate sounds if problems occur, and the loud speaker is adapted to send out audio instructions to help a user fix the problems.

The present invention will become clearer in light of the following detailed description of illustrative embodiments of this invention described in connection with the drawings.

DETAILED DESCRIPTION OF THE INVENTION

Figure 1:
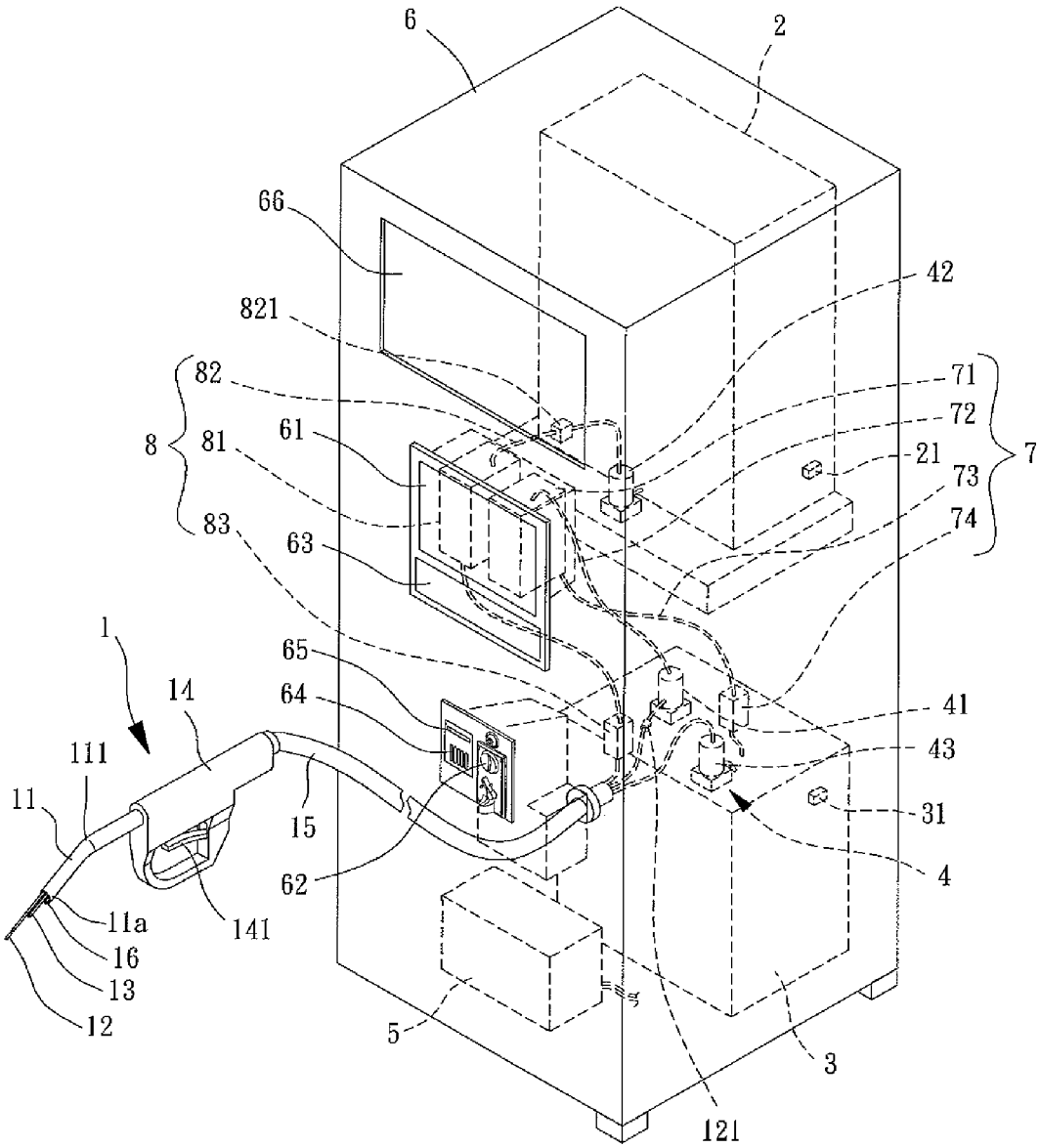
FIG. 1 is a perspective view of a self-help oil changing apparatus according to the present invention.
Figure 2:
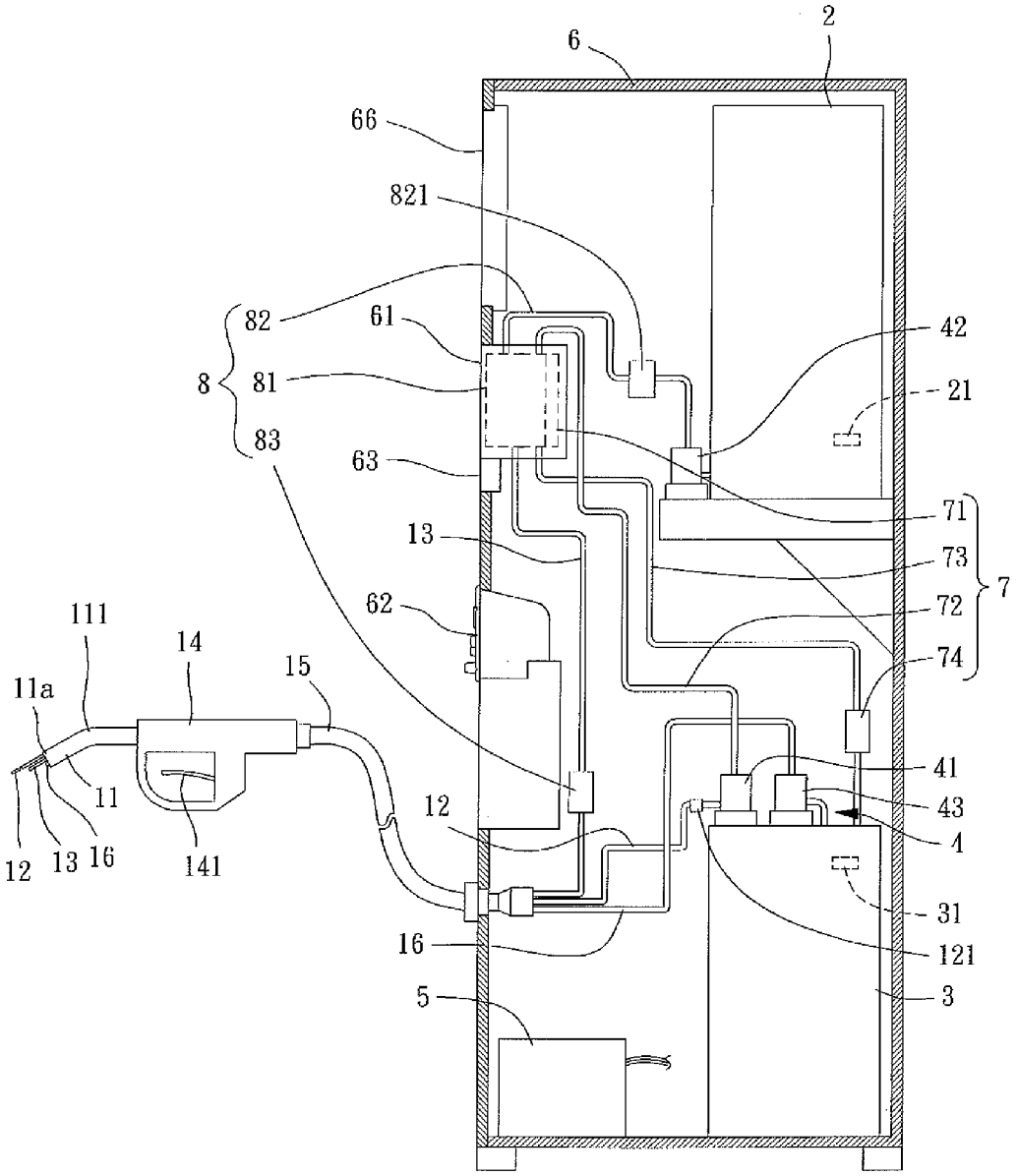
FIG. 2 is a cross sectional view of the self-help oil changing apparatus of FIG. 1.

With reference to FIGS. 1-2, a self-help oil changing apparatus according to the present invention includes a nozzle 1, a clean oil tank 2, a dirty oil tank 3, an oil pressure control module 4, and a control unit 5. The nozzle 1 receives tubes respectively in communication with the clean oil tank 2 and the dirty oil tank 3. The control unit 5 controls the oil pressure control module 4 to operate the nozzle 1 to suck dirty oil out of a vehicle and then fill clean oil into the vehicle, assisting a user in changing the oil of the vehicle by himself or herself. Preferably, the self-help oil changing apparatus further includes a housing 6 receiving the clean oil tank 2, the dirty oil tank 3, the oil pressure control module 4, and the control unit 5. Thus, the housing 6 can protect these components from damage and destruction. The oil to be changed by the self-help oil changing apparatus according to the present invention can be engine oil, gear oil, or other oil. The structural arrangement of the self-help oil changing apparatus according to the present invention can be varied according to the type of the vehicles, such as motorcycles, automobiles, or trucks. An embodiment of the self-help oil changing apparatus according to the present invention will be described by way of example of changing engine oil of motorcycles without any restrictive intention.

Figure 3:
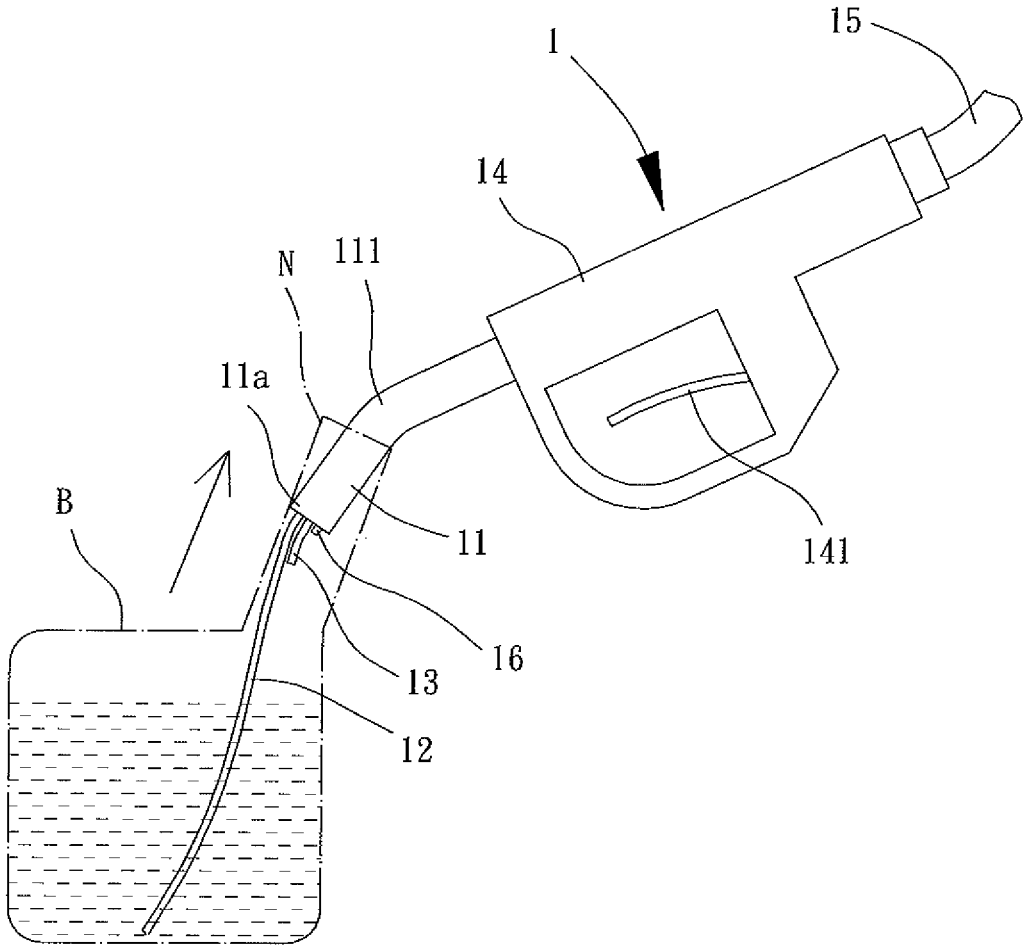
FIG. 3 is a schematic view illustrating oil sucking operation of the self-help oil changing apparatus of FIG. 1, with dirty engine oil sucked out of an engine oil tank of a vehicle.

With reference to FIG. 3, the nozzle 1 includes an outer tube 11, an oil suction tube 12, and an oil filling tube 13. The outer tube 11 is exposed outside of the housing 6. Each of the oil suction tube 12 and the oil filling tube 13 has an exposed portion exposed outside of the housing 6. The outer tube 11 is a rigid tube having a predetermined shape. The outer tube 11 has an insertion end 11*a* to be inserted into an engine oil tank B. The engine oil tank B has an oil filling neck N through which the outer tube 11 is inserted into the engine oil tank B. The outer tube 11 can further include a label portion 111 to assist a user in accurately inserting the outer tube 11 into the engine oil tank B to a predetermined depth. As an example, the label portion 111 can be a mark engraved in or glued to an outer periphery of the outer tube 11, or a protrusion formed on the outer periphery of the outer tube 11, or a bend of the outer tube 11 in the form shown. When the user inserts the outer tube 11 into the oil filling neck N of the engine oil tank B to the predetermined depth, the label portion 111 abuts against an inner periphery of the oil filling neck N to prevent further insertion movement of the outer tube 11 into the engine oil tank B.

Preferably, the oil suction tube 12 and the oil filling tube 13 are flexible hoses and are received in the outer tube 11 providing protection. When the outer tube 11 is inserted into the engine oil tank B, an end of each of the oil suction tube 12 and the oil filling tube 13 is also placed into the engine oil tank B. Specifically, the end of each of the oil suction tube 12 and the oil filling tube 13 to be placed into the engine oil tank B extends out of the insertion end 11*a* of the outer tube 11. A length of the oil suction tube 12 extending out of the insertion end 11*a* of the outer tube 11 can be equal to or not equal to than a length of the oil filling tube 13 extending out of the insertion end 11*a* of the outer tube 11. Preferably, the length of the oil suction tube 12 extending out of the insertion end 11*a* of the outer tube 11 is larger than the length of the oil filling tube 13 extending out of the insertion end 11*a* of the outer tube 11. Thus, when the oil suction tube 12 and the oil filling tube 13 are inserted into the engine oil tank B together with the outer tube 11, the oil suction tube 12 approximately reaches a bottom of the engine oil tank B, and the oil filling tube 13 is located in the oil filling neck B. This avoids submersion of the oil filling tube 13 in viscous dirty oil having more impurities. The other ends of the oil suction tube 12 and the oil filling tube 13 are respectively in communication with the dirty oil tank 3 and the clean oil tank 2 to suck the oil to be changed into the dirty oil tank 3 via the oil suction tube 12 and to fill clean oil from the clean oil tank 2 into the engine oil tank B via the oil filling tube 13, which will be described in detail later. The oil suction tube 12 further includes a pressure sensor 121 electrically connected to the control unit 5 to detect whether the fluid flowing in the oil suction tube 12 is a liquid or a gas.

Still referring to FIG. 1, in this embodiment, the nozzle 1 further includes a grip 14 and a receiving tube 15. The grip 14 allows easy gripping and operation by the user. The grip 14 is connected to the other end of the outer tube 11. The oil suction tube 12 and the oil filling tube 13 extend through an interior of the grip 14. The grip 14 includes an actuation switch 141 electrically connected to the control unit 5. After the outer tube 11 is inserted into the engine oil tank B, the user can trigger the actuation switch 141 to proceed with the engine oil change operation. Preferably, the receiving tube 15 is also a flexible hose. An end of the receiving tube 15 is connected to the grip 14. The exposed portion of each of the oil suction tube 12 and the oil filling tube 13 is enveloped by the receiving tube 15 for protection purposes.

Still referring to FIG. 3, preferably, the nozzle 1 further includes an overflow tube 16 extending through the outer tube 11, the grip 14, and the receiving tube 15. An end of the overflow tube 16 is in communication with the dirty oil tank 3. The other end of the overflow tube 16 extends out of the insertion end 11*a* of the outer tube 11. A length of the overflow tube 16 extending out of the insertion end 11*a* of the outer tube 11 is preferably smaller than the length of the oil filling tube 13 extending out of the insertion end 11*a* of the outer tube 11. Thus, excessive engine oil can be removed instantly, avoiding overflow of the engine oil.

With reference to FIGS. 1 and 2, the clean oil tank 2 receives clean engine oil, and the dirty oil tank 3 receives the dirty engine oil changed. The clean oil tank 2 and the dirty oil tank 3 can be unclosed tanks such that the pressures in the tanks will not significantly change due to an increase or decrease in the amount of oil stored in the tanks, maintaining smooth operation of sucking or filling oil out of or into the tanks. The clean oil tank 2 and the dirty oil tank 3 are mounted in predetermined locations of the housing 6 and can be arranged to align with each other in the vertical or horizontal direction. In this embodiment, the clean oil tank 2 and the dirty oil tank 3 are aligned with each other in the vertical direction to reduce the ground area of the housing 6.

Each of the clean oil tank 2 and the dirty oil tank 3 can further include an oil level sensor 21, 31 electrically connected to the control unit 5. Preferably, the oil level sensor 21 in the clean oil tank 2 is located adjacent to a bottom of the clean oil tank 2. In a case that the amount of clean engine oil in the clean oil tank 2 is small, the oil level sensor 21 can send an electric signal to the control unit 5, which, in turn, sends a signal indicative of supplying clean engine oil to a managing unit through wire or wireless communication. Preferably, the oil level sensor 31 in the dirty oil tank 3 is located adjacent to a top of the dirty oil tank 3. In a case that the dirty engine oil reaches a predetermined amount, the oil level sensor 31 can send a signal to the control unit 5, which, in turn, sends a signal indicative of removing dirty engine oil to the managing unit through wire or wireless communication.

Thus, the managing unit can instantly send workers to supply clean engine oil or remove dirty engine oil without unnecessary waste of labor and fuel required for regular inspection. The oil supply efficiency is increased, and the managing costs are reduced.

The oil pressure control module 4 is mounted in the housing 6. In this embodiment, the oil pressure control module 4 includes a dirty oil pump 41, a clean oil pump 42, and an overflow pump 43. The control unit 5 is electrically connected to and controls the operation timing of the dirty oil pump 41, the clean oil pump 42, and the overflow pump 43. The dirty oil pump 41 is connected to the oil suction tube 12 and is in communication with the dirty oil tank 3. When the dirty oil pump 41 operates, a negative pressure is created relative to the oil suction tube 12 to suck the dirty engine oil to be changed into the dirty oil tank 3 via the oil suction tube 12. The clean oil pump 42 is in communication with the oil filling tube 13 and the clean oil tank 2. When the clean oil pump 42 operates, a negative pressure is created relative to the clean oil tank 2 to fill clean engine oil into the oil filling tube 13. The overflow pump 43 is connected to the overflow tube 16 and is in communication with the dirty oil tank 3 to form a negative pressure in the overflow tube 16 for continuously sucking air away or sucking excessive engine oil and guiding the excessive engine oil into the dirty oil tank 3 when excessive engine oil is filled into the engine oil tank B via the oil filling tube 13.

Furthermore, the self-help oil changing apparatus according to the present invention includes a dirty oil temporary storage assembly 7 and a clean oil temporary storage assembly 8. Each of the dirty oil temporary storage assembly 7 and the clean oil temporary storage assembly 8 has a temporary storage tank 71, 81 located in a predetermined location in the housing 6. The housing 6 can include a window 61 aligned with the temporary storage tanks 71 and 81, allowing the user to view the temporary storage tanks 71 and 81. The temporary storage tanks 71 and 81 respectively provide temporary storage spaces for dirty engine oil and clean engine oil. The user can see how much dirty engine oil is sucked from the engine oil tank B of his or her vehicle and can see the amount of clean engine oil to be filled.

In this embodiment, the dirty oil temporary storage assembly 7 further includes a first oil tube 72, a second oil tube 73, and a first valve 74. The first oil tube 72 has two ends respectively connected to the temporary storage tank 71 and an end of the dirty oil pump 41. The second oil tube 73 has two ends respectively connected to the temporary storage tank 71 and the dirty oil tank 3. Preferably, the second oil tube 73 is connected to the temporary storage tank 71 at a location adjacent to a bottom of the temporary storage tank 71. The first valve 74 is mounted on the second oil tube 73 and electrically connected to the control unit 5.

The clean oil temporary storage assembly 8 further includes a third oil tube 82 and a second valve 83. The third oil tube 82 has two ends respectively connected to the temporary storage tank 81 and an end of the clean oil pump 42. The third oil tube 82 preferably includes a flow meter 821 electrically connected to the control unit 5 for measuring the amount of clean engine oil filled into the temporary storage tank 81. The other end of the oil filling tube 13 is in communication with the temporary storage tank 81 and preferably at a location adjacent to a bottom of the temporary storage tank 81. The second valve 83 is mounted on the oil filling tube 13 and is electrically connected to the control unit 5. The first and second valve 74 and 83 can be, but not limited to, electromagnetic valves.

In addition to the above structure, the self-help oil changing apparatus according to the present invention can include other components to provide more functions.

In this embodiment, the housing 6 further includes a payment device 62, a touch control screen 63, and an alarm device 64, all of which are electrically connected to the control unit 5. The payment device 62 can include at least one slot receiving coins and/or bills. After confirmation of payment, the engine oil change process can be conducted. Touch control screen 63 is adapted to be operated by a user to control an amount of clean oil to be changed, to display operation statuses, or to display operational instructions. The alarm device 64 can remind the user of situations or providing the user with solutions of problems. As an example, the alarm device 64 is an alarm light that flashes if problems occur, and the touch control screen 63 can display instructions for fixing the problems. In another example, the alarm device 64 is a microcomputer having a loud speaker. The loud speaker generates sounds if problems occur. The loud speaker can send out audio instructions to help a user fix the problems. Furthermore, the housing 6 preferably includes an invoice machine 65 electrically connected to the control unit 5 and a display 66 electrically connected to the control unit 5. The display 66 can broadcast outdoor advertisements, instant news, or live sports such that the user would not feel boring while waiting. Further, the housing 6 can receive an air compressor (not shown) allowing the user to inflate the wheels of the vehicle.

Figure 4:
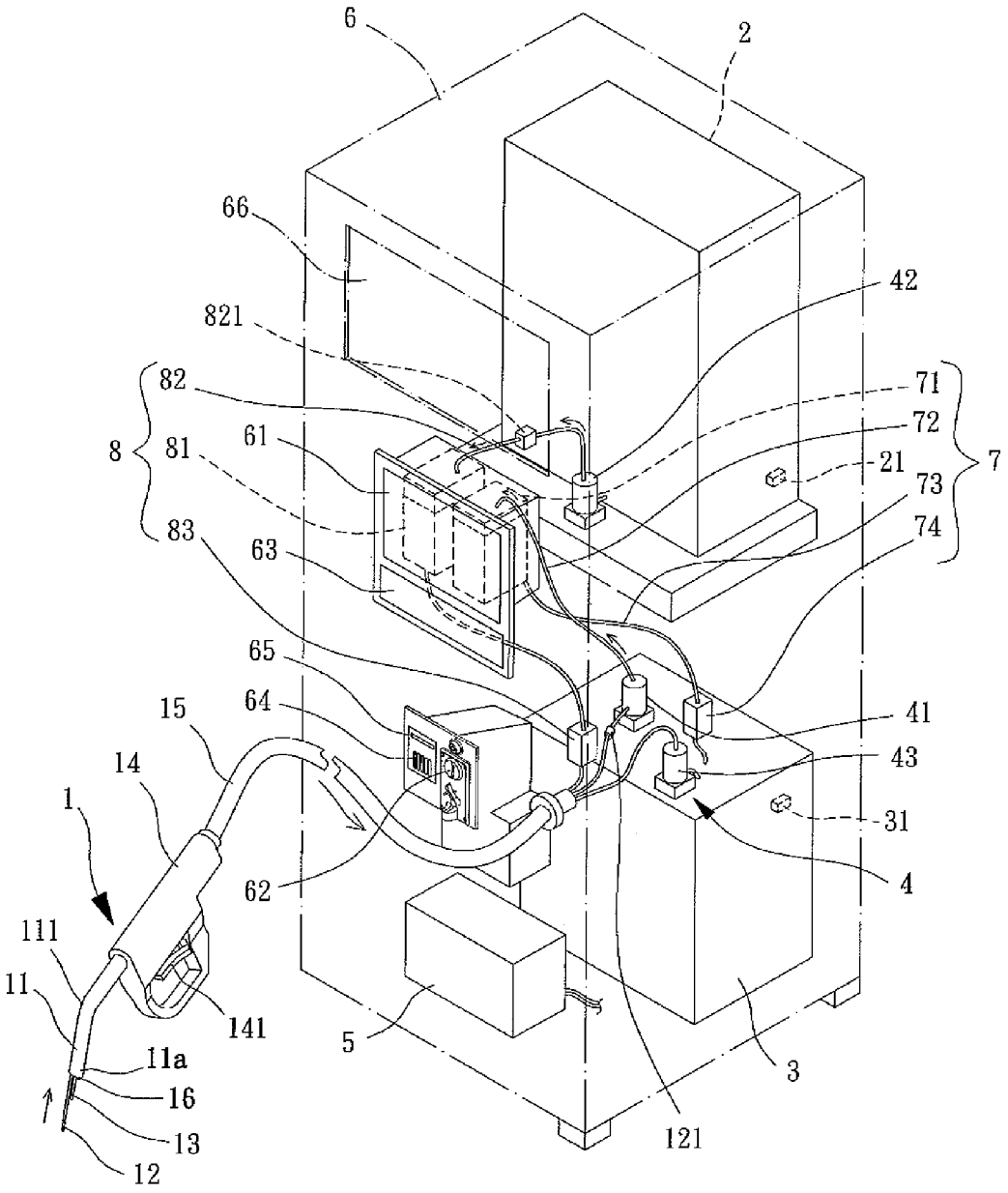
FIG. 4 is a schematic view illustrating oil sucking operation of the self-help oil changing apparatus of FIG. 1, with dirty engine oil sucked into a temporary dirty oil storage tank.

With reference to FIGS. 3 and 4, when the user is intended to use the self-help oil changing apparatus according to the present invention to change the engine oil of his or her vehicle, the vehicle is parked in an area reachable to the nozzle 1. The user pays the fees through the payment device 62, and the touch control screen 63, the dirty oil pump 41, the clean oil pump 42, and the overflow pump 43 are in standby statuses through control by the control unit 5. The first and second valves 74 and 83 are in a closed state.

Next, the user select the amount of engine oil through the touch control screen 63, and the control signal is sent to the control unit 5 that controls the clean oil pump 42 to operate. Clean engine oil is drawn from the clean oil tank 2 into the temporary storage tank 81 of the clean oil temporary storage assembly 8 via the third oil tube 82, and the user can see the clean engine oil to be filled into the engine oil tank B via the window 61. Note that the second valve 83 is in the closed state so that the clean engine oil can be temporary stored in the temporary storage tank 81 instead of directly flowing into the engine oil tank B via the oil filling tube 13. The amount of engine oil flowing through the third tube 82 can be measured by the flow meter 821. After the selected amount of the clean engine oil is filled into the temporary storage tank 81, the clean oil pump 42 starts to operate under control by the control unit 5.

On the other hand, the user inserts the outer tube 11 into the engine oil tank B until the label portion 111 abuts the inner periphery of the oil filling neck N. In this case, the ends of the oil suction tube 12 and the oil filling tube 13 are also in the engine oil tank B. The oil suction tube 12 can reach approximately the bottom of the engine oil tank B while the oil filling tube 13 is located in the oil filling neck B.

Then, the user triggers the actuation switch 141 to send an electric signal back to the control unit 5, which, in turn, activates the dirty oil pump 41 to suck the dirty engine oil in the engine oil tank B via the oil suction tube 12. The dirty engine oil flows into and is temporarily stored in the temporary storage tank 71 of the dirty oil temporary storage assembly 7, and the user can see the dirty engine oil sucked out of the engine oil tank B via the window 61. Since the first valve 74 is in the closed state, the dirty engine oil can temporarily be stored in the temporary storage tank 71 instead of directly flowing into the dirty oil tank 3.

The dirty oil pump 41 stops operation after a predetermined period of operational time under control of the control unit 5. The operational time is preferably the time required for sucking more than 95% of the dirty engine oil out of the engine oil tank B (about 20 seconds) and preferably plus 10-20 seconds of buffering time. In operation, if the dirty oil pump 41 sucks air after a short period of time, the pressure sensor 121 is activated to send an electric signal back to the control unit 5, which, in turn, controls the alarm device 64 to send out an alarm message displayed on the touch control screen 63 or an audio warning to remind the user to adjust the position of the outer tube 11, assuring the end of the oil suction tube 12 has reached the bottom of the engine oil tank B for continuing sucking of the dirty engine oil.

Note that if the self-help oil changing apparatus according to the present invention includes the dirty oil temporary storage assembly 7 and the clean oil temporary storage assembly 8, the first and second valves 74 and 83 can provide a pausing effect during oil filling operation. Thus, the operating sequence of the dirty oil pump 41 and the clean oil pump 42 is not limited; namely, one can be activated after the other, or activation of one of them can be delayed, or both of them can be activated simultaneously. The operational result is not affected. If simultaneous activation of the dirty oil pump 41 and the clean oil pump 42 increases the efficiency, simultaneous activation is preferably set. On the other hand, if the self-help oil changing apparatus according to the present invention does not include the dirty oil temporary storage assembly 7 and the clean oil temporary storage assembly 8, the clean oil pump 42 can be activated to fill the clean engine oil into the engine oil tank B only after the dirty engine oil has been sucked out of the engine oil tank B by the dirty oil pump 41.

Figure 5:
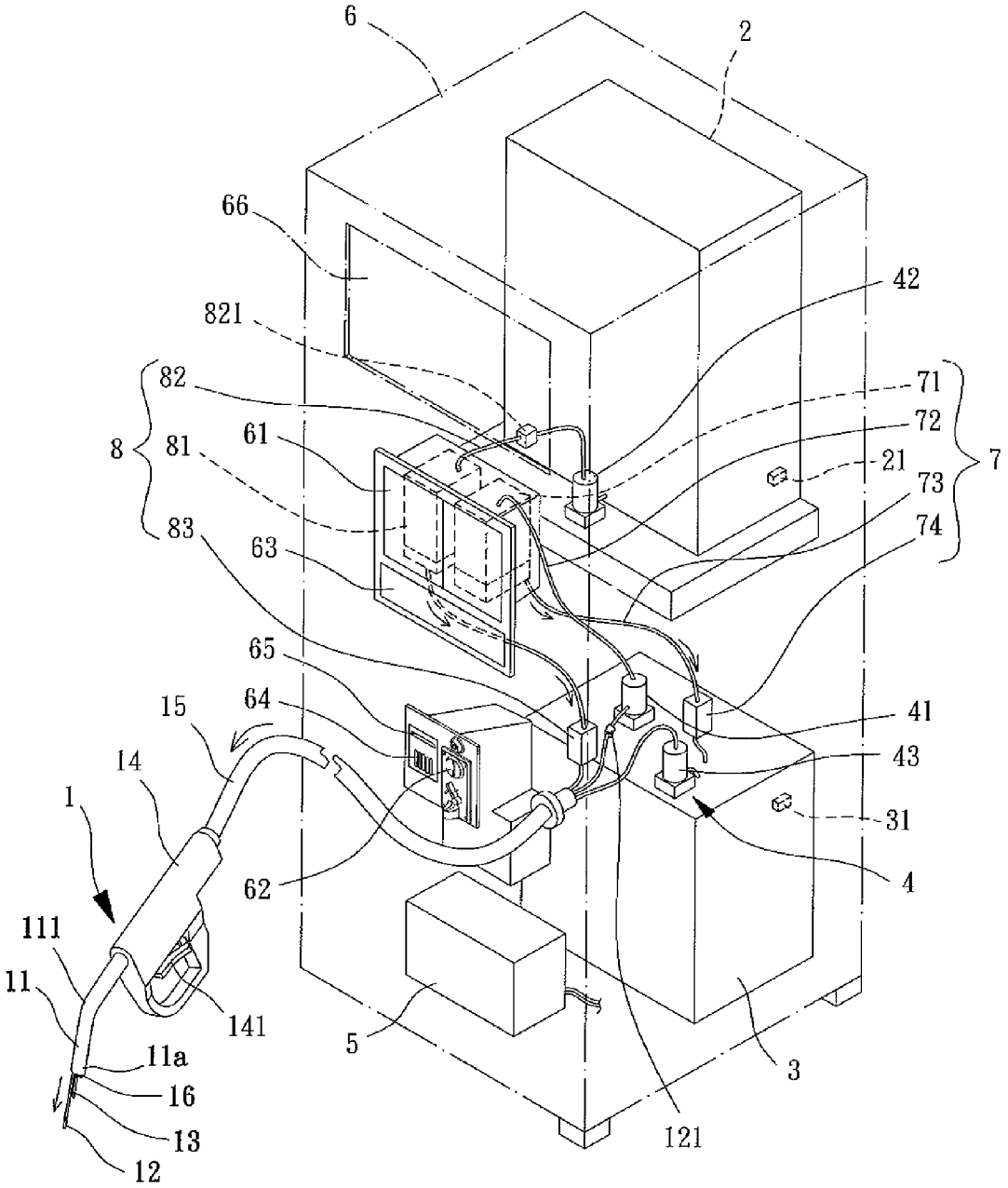
FIG. 5 is a schematic view illustrating oil filling operation of the self-help oil changing apparatus of FIG. 1, with clean flowing from a temporary clean oil storage tank to an oil filling tube.
Figure 6:
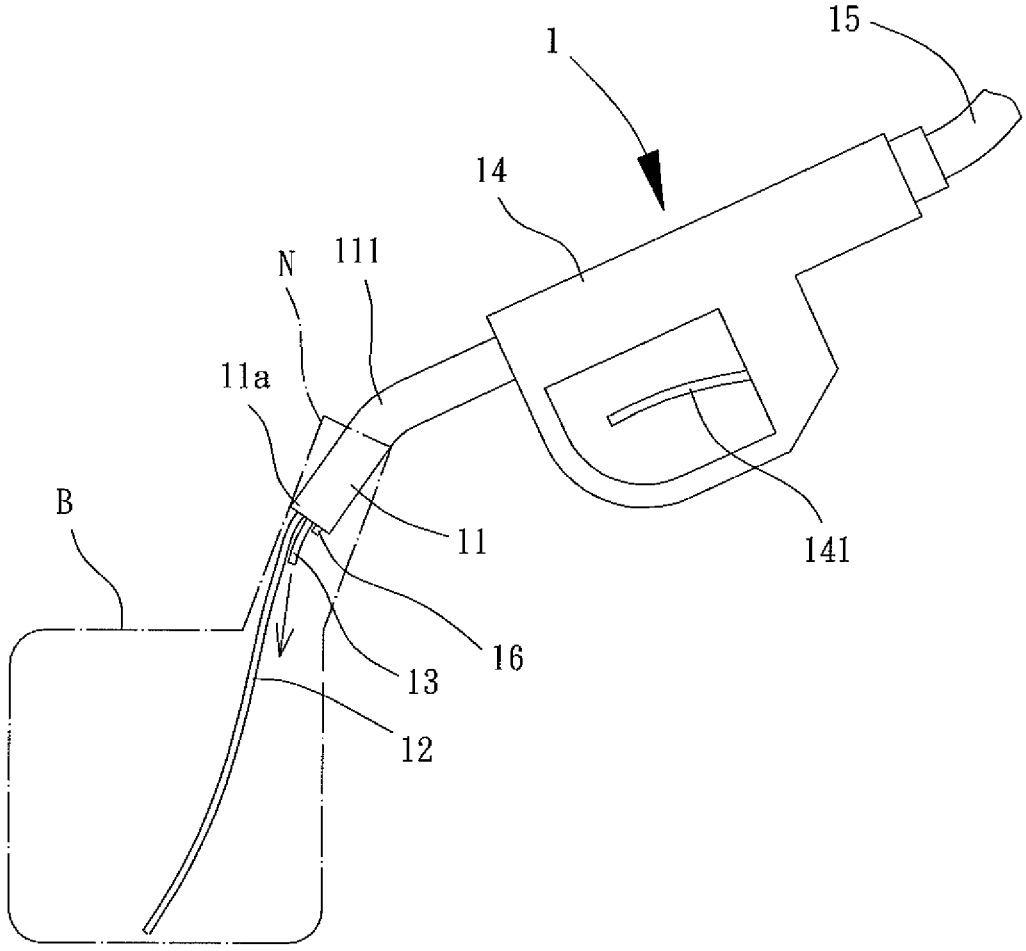
FIG. 6 is a schematic view illustrating oil filling operation of the self-help oil changing apparatus of FIG. 1, with clean engine oil filled into the engine oil tank of the vehicle.

With reference to FIGS. 5 and 6, while filling the clean engine oil and dirty engine oil respectively into the temporary storage tanks 71 and 81, the gas in the temporary storage tanks 71 and 81 are gradually compressed such that the control unit 5 switches the first and second valves 74 and 83 into an open state after the dirty oil pump 41 is shut down after working over the predetermined period of time, using the potential and the gas pressure in the temporary storage tanks 71 and 81 to force the dirty engine oil in the temporary storage tank 71 to flow through the first valve 74 and the second oil tube 73 into the dirty oil tank 3. The clean engine oil in the temporary storage tank 81 flows through the second valve 83 and the oil filling tube 13 into the engine oil tank B, accomplishing the self-help oil change process.

Figure 7:
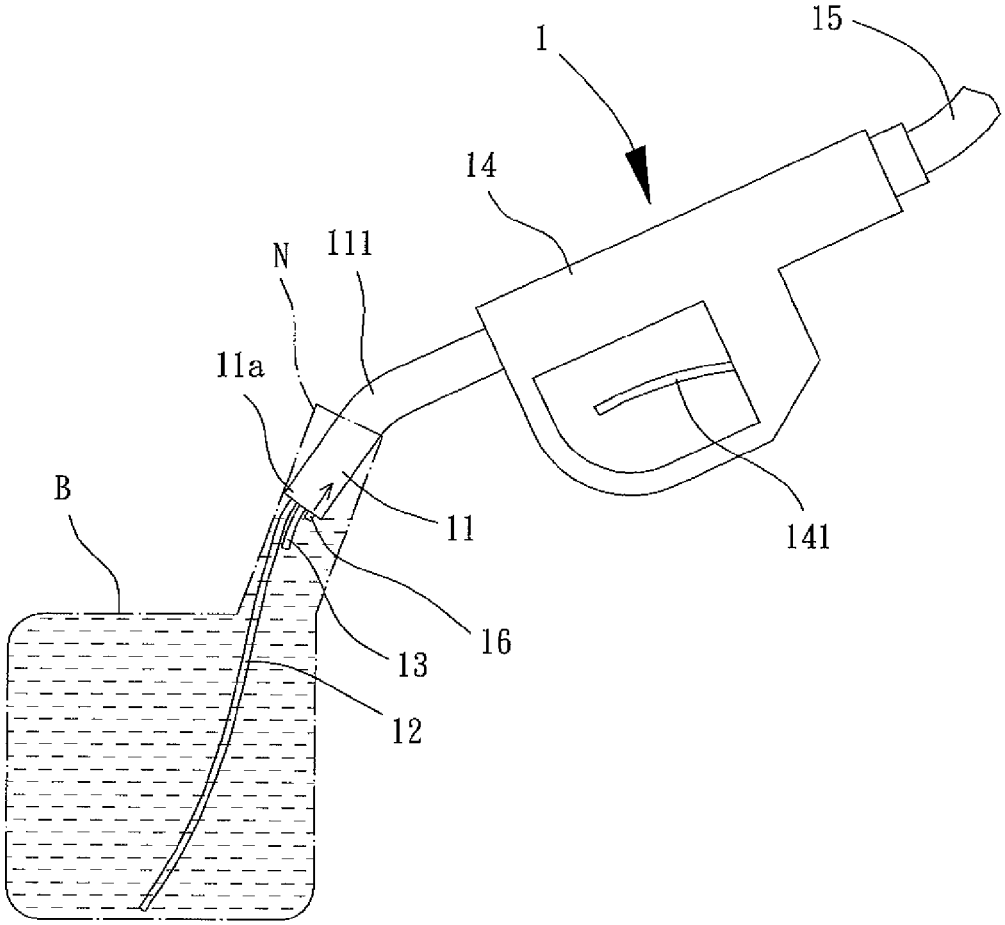
FIG. 7 is a view similar to FIG. 5, illustrating oil overflow in the engine oil tank.
Figure 8:
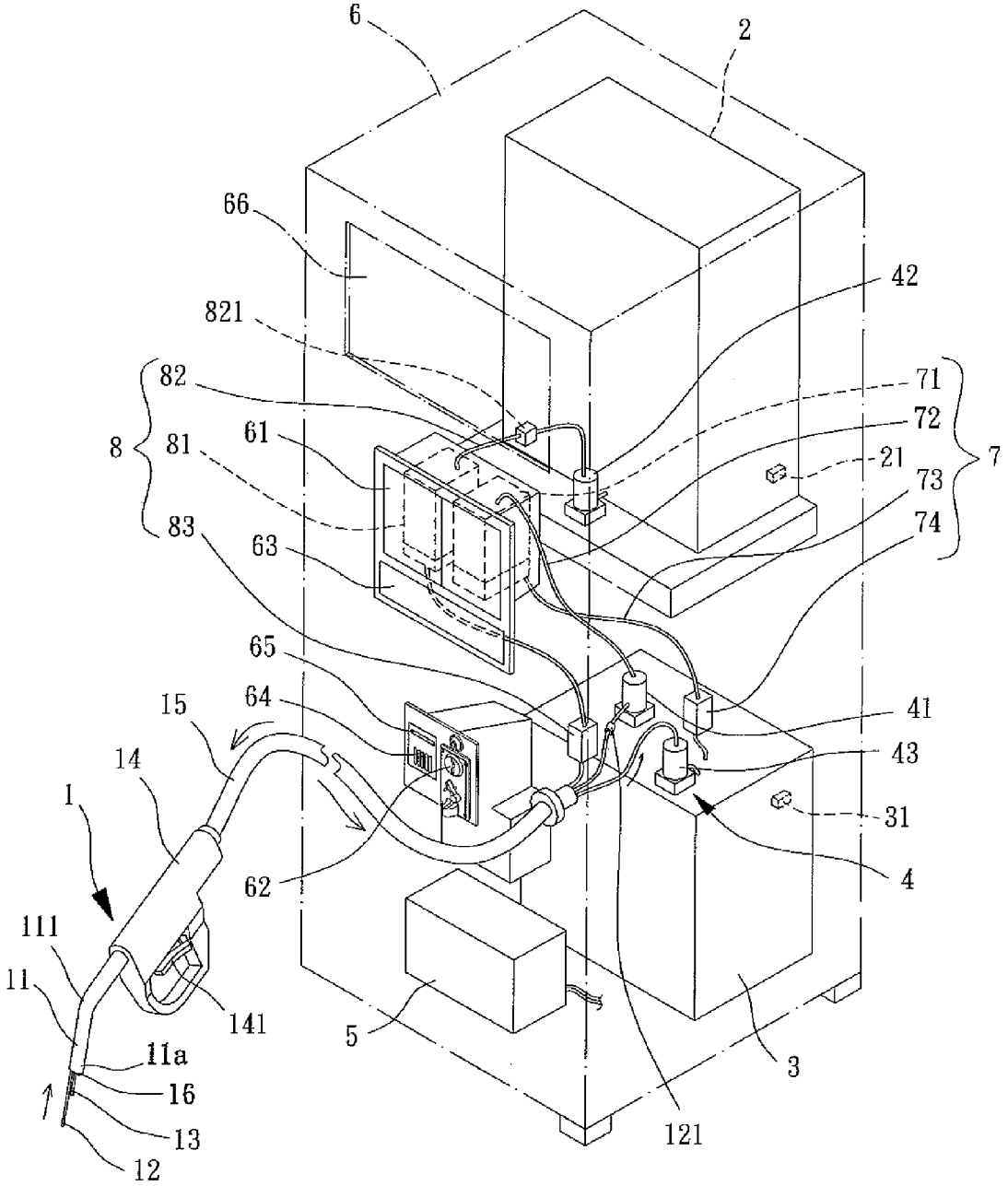
FIG. 8 is a schematic view illustrating operation of the self-help oil changing apparatus of FIG. 1 in the case of oil overflow.

With reference to FIGS. 7 and 8, during normal operation, the oil filling tube 13 will fill a predetermined amount of clean engine oil into the engine oil tank B. However, in a case of malfunction or improper operation by the user, the oil filling tube 13 could fill excessive clean engine oil into the engine oil tank B. In this case, the continuously working overflow pump 43 can suck away the excessive engine oil via the overflow tube 16 and guide the excessive engine oil into the dirty oil tank 3, avoiding overflow of engine oil out of the engine oil tank B and maintaining a tidy working environment.

In view of the forging, the operational steps of the self-help oil changing apparatus according to the present invention are easy. After paying the fees and correctly inserting the insertion end 11*a* of the nozzle 1 into the engine oil tank B, suction of the dirty engine oil and filling of the clean engine oil can be conducted automatically. The engine oil change process can be accomplished in 3-5 minutes, increasing the oil change efficiency.

In operation of the self-help oil changing apparatus according to the present invention, the user can simply remove the cap of the engine oil tank B before the oil change process and put the cap back after the oil change process, reducing the risk of contacting the engine oil by the skin of the user and therefore avoiding adverse affect to health.

The self-help oil changing apparatus according to the present invention can be operated by the user at any time without restriction by the working hours of maintenance works, increasing the use convenience.

Since a large amount of clean engine oil in the clean oil tank 2 is directly stored in the self-help oil changing apparatus according to the present invention, it is not necessary to package a small amount of engine oil bottle by bottle, significantly saving the costs for packaging materials and reducing the material costs. Furthermore, the user can operate the self-help oil changing apparatus himself or herself to save the labor costs, significantly reducing the costs for changing the oil. Taking an engine oil change as an example, the expense is about NT$100 by using the self-help oil changing apparatus according to the present invention, which is much cheaper than NT$150-250 required in a conventional engine oil change. The consumer can see the cost saving effect and is, thus, encouraged to regularly change the engine oil. Thus, the service life of the engine can be prolonged through regular maintenance of the vehicle.

Furthermore, the self-help oil changing apparatus according to the present invention can effectively reduce the garbage by significantly saving the packaging materials, providing environmental protection.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A self-help oil changing apparatus comprising:

a nozzle including an outer tube, an oil suction tube, and an oil filling tube, with the outer tube having an insertion end, with the oil suction tube and the oil filling tube received in the outer tube, with each of the oil suction tube and the oil filling tube having an end extending out of the insertion end of the outer tube;

a clean oil tank in communication with another end of the oil filling tube;

a dirty oil tank in communication with another end of the oil suction tube;

an oil pressure control module including a dirty oil pump and a clean oil pump, with the dirty oil pump connected to the oil suction tube and in communication with the dirty oil tank, with the clean oil pump in communication with the oil filling tube and the clean oil tank; and a control unit electrically connected to the dirty oil pump and the clean oil pump to control operations of the dirty oil pump and the clean oil pump; with the nozzle further including an overflow tube extending through the outer tube, with the overflow tube extending out of the insertion end of the outer tube together with the ends of the oil suction tube and the oil filling tube, with the oil pressure control module further including an overflow pump connected to the overflow tube and in communication with the dirty oil tank, with the overflow pump electrically connected to the control unit.

2. The self-help oil changing apparatus as claimed in claim 1, with the oil suction tube further including a pressure sensor electrically connected to the control unit.

3. The self-help oil changing apparatus as claimed in claim 1, with a length of the overflow tube extending out of the insertion end of the outer tube smaller than a length of the oil filling tube extending out of the insertion end of the outer tube.

4. The self-help oil changing apparatus as claimed in claim 1, further comprising: a housing, with the clean oil tank, the dirty oil tank, and the oil pressure control module received in the housing, with the outer tube of the nozzle exposed outside of the housing, with each of the oil suction tube and the oil filling tube having an exposed portion exposed outside of the housing.

5. The self-help oil changing apparatus as claimed in claim 4, with the nozzle further including a grip connected to another end of the outer tube, with the oil suction tube and the oil filling tube extending through an interior of the grip, with the grip including an actuation switch electrically connected to the control unit.

6. The self-help oil changing apparatus as claimed in claim 5, with the nozzle further including a receiving tube, with each of the receiving tube, the oil suction tube, and the oil filling tube being a flexible hose, with the receiving tube including an end connected to the grip, with the exposed portion of each of the oil suction tube and the oil filling tube enveloped by the receiving tube.

7. The self-help oil changing apparatus as claimed in claim 4, further comprising: a clean oil temporary storage assembly and a dirty oil temporary storage assembly, with each of the clean oil temporary storage assembly and the dirty oil temporary storage assembly having a temporary storage tank received in the housing, with the housing including a window aligned with the temporary storage tanks of the clean oil temporary storage assembly and the dirty oil temporary storage assembly.

8. The self-help oil changing apparatus as claimed in claim 7, with the dirty oil temporary storage assembly further including a first oil tube, a second oil tube, and a first valve, with the first oil tube having two ends respectively connected to the temporary storage tank of the dirty oil temporary storage assembly and an end of the dirty oil pump, with the second oil tube having two ends respectively connected to the temporary storage tank of the dirty oil temporary storage assembly and the dirty oil tank, with the first valve mounted on the second oil tube and electrically connected to the control unit, with the clean oil temporary storage assembly further including a third oil tube and a second valve, with the third oil tube having two ends respectively connected to the temporary storage tank of the clean oil temporary storage assembly and an end of the clean oil pump, with the other end of the oil filling tube being in communication with the temporary storage tank of the clean oil temporary storage assembly, with the second valve mounted on the oil filling tube and electrically connected to the control unit.

9. The self-help oil changing apparatus as claimed in claim 8, with the third oil tube including a flow meter electrically connected to the control unit.

10. The self-help oil changing apparatus as claimed in claim 4, with the outer tube being a rigid tube and having a label portion, with the label portion being a mark on an outer periphery of the outer tube, or a protrusion formed on the outer periphery of the outer tube, or a bend of the outer tube.

11. The self-help oil changing apparatus as claimed in claim 4, with a length of the oil suction tube extending out of the insertion end of the outer tube larger than a length of the oil filling tube extending out of the insertion end of the outer tube.

12. The self-help oil changing apparatus as claimed in claim 4, with each of the clean oil tank and the dirty oil tank including an oil level sensor electrically connected to the control unit.

13. The self-help oil changing apparatus as claimed in claim 4, with the housing further including a payment device electrically connected to the control unit.

14. The self-help oil changing apparatus as claimed in claim 4, with the housing further including a touch control screen electrically connected to the control unit, with the touch control screen adapted to be operated by a user to control an amount of clean oil to be changed, to display operation statuses, or to display operational instructions.

15. The self-help oil changing apparatus as claimed in claim 14, with the housing further including an alarm device electrically connected to the control unit, with the alarm device being an alarm light, with the alarm light adapted to flash if problems occur, with the touch control screen adapted to display instructions for fixing the problems.

16. The self-help oil changing apparatus as claimed in claim 4, with the housing further including an alarm device electrically connected to the control unit, with the alarm device being a microcomputer having a loud speaker, with the loud speaker adapted to generate sounds if problems occur, with the loud speaker adapted to send out audio instructions to help a user fix the problems.

* * * * *